US005938088A

United States Patent [19]

Lam

[11] Patent Number: 5,938,088

[45] Date of Patent: Aug. 17, 1999

[54] HANDICRAFT DISPLAY APPARATUS

[76] Inventor: Peter Ar-Fu Lam, 20104 Wayne Ave., Torrance, Calif. 90503

[21] Appl. No.: 08/812,530

[22] Filed: Mar. 8, 1997

Related U.S. Application Data

[63] Continuation of application No. 08/375,534, Jan. 19, 1995, Pat. No. 5,649,651.

[51] Int. Cl.[6] ..... A47G 25/14

[52] U.S. Cl. ..... 223/85; 223/72

[58] Field of Search ..... 223/85, 92, 88, 223/1; D6/315, 316

[56] References Cited

U.S. PATENT DOCUMENTS

| | | | |
|---|---|---|---|
| D. 215,898 | 11/1969 | Javonovich | D6/316 |
| D. 229,002 | 11/1973 | Brannon | D6/375 |
| D. 253,447 | 11/1979 | Tully | D6/316 |
| 1,096,018 | 3/1914 | Buchwald | D6/316 |
| 3,126,237 | 3/1964 | Kirk | 223/85 |
| 4,739,911 | 4/1988 | Quinn | 223/85 |
| 5,022,569 | 6/1991 | Beaulieu | 223/85 |
| 5,649,651 | 7/1997 | Lam | 223/85 |

*Primary Examiner*—Bibhu Mohanty

[57] ABSTRACT

An apparatus especially configured to encourage children to produce and display handicraft works while also encouraging them to properly care for their articles of clothing. The apparatus is also suitable for users to easily coordinate or harmonize apparel before putting the clothing on. The embodiments include a frame member defining a display region configured for accommodating a handicraft. In a first embodiment, the frame member is especially configured for accommodating a substantially planar, i.e., two dimensional, handicraft in the display region. In a second embodiment, the frame member is configured for accommodating a three dimensional handicraft, e.g., a floral arrangement, in the display region. In a third embodiment, the frame member is configured for accommodating the image of a real human face.

3 Claims, 7 Drawing Sheets

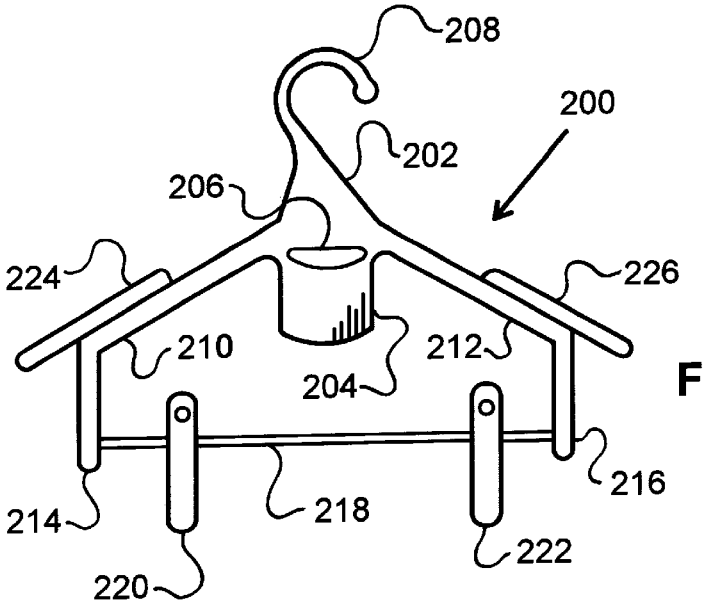
Figure 11
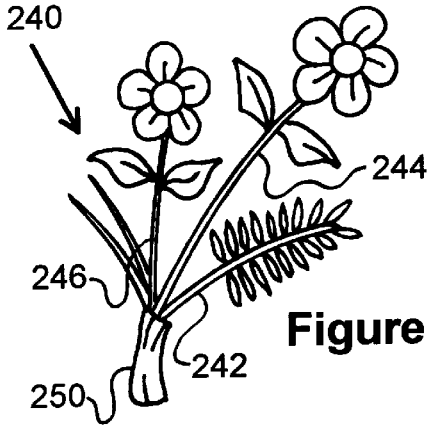
Figure 12
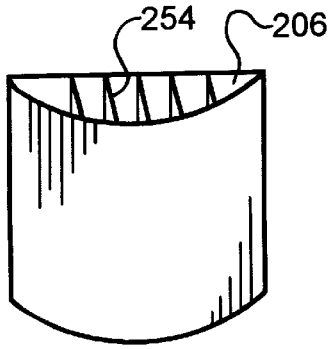
Figure 13
Figure 14
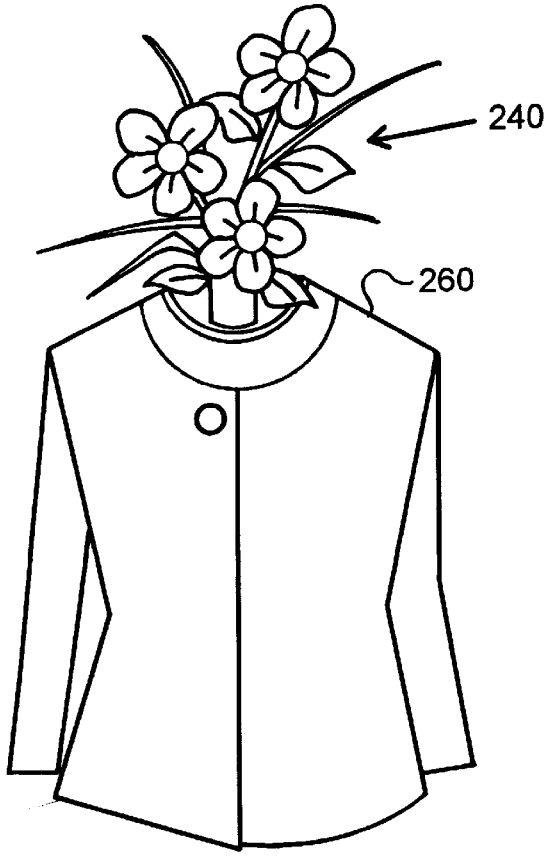

HANDICRAFT DISPLAY APPARATUS

RELATED APPLICATIONS

This application is a continuation-in-part of now U.S. Pat. No. 5,699,631 pending U.S. patent application Ser. No. 08/375,534 filed Jan. 19, 1995 which is by reference incorporated herein.

BACKGROUND OF THE INVENTION

This application is to further precisely defining the variation of U.S. patent application Ser. No. 08/375,534 filed Jan. 19, 1995 which is by reference incorporated herein.

This invention relates generally to apparatus for displaying handicraft works and more particularly, to an article of manufacture especially configured for use by children and adults for enabling them to decorate or personalize a device for supporting articles of clothing by displaying a handicraft thereon. Further application of the invention discloses an apparatus for displaying articles of clothing for facilitating a user's selection of coordinating articles.

The prior art reveals many garment hangers suitable for use by children. For example only, attention is directed to the following U.S. Patents:

| | | |
|---|---|---|
| Des. 204,341 | 1,096,018 | 3,205,614 |
| Des. 158,922 | 3,126,237 | |

SUMMARY OF THE INVENTION

The present invention is firstly directed to an apparatus especially configured to encourage children to produce and display handicraft works while also encouraging them to properly care for their articles of clothing. The embodiments of the invention include a frame member defining a display region configured for removably accommodating a child's handicraft. In a first preferred embodiment, the frame member is especially configured for accommodating a substantially planar, i.e., two dimensional, handicraft in the display region. In a second preferred embodiment, the frame member is configured for accommodating a three dimensional handicraft, e.g., a floral arrangement, in the display region.

In accordance with the preferred embodiments, first and second elongate arms extend in opposite directions from the frame member for supporting articles of clothing. Additionally, a hook member extends from the frame member for vertically suspending the frame member from a horizontally oriented support surface, e.g., on a stationary hook, a door top, or a rod.

In accordance with the first embodiment, the frame member defines the periphery of a display area for accommodating a substantially planar handicraft having a decorative front face such as a picture, drawing, painting, photograph or needlework. The concept of handicraft includes the formation of art, picture, facial illustrations with the support of computers, computer software, computer printer as means to form the personalized handicraft. The frame member preferably includes a backing panel and a transparent display panel. The display panel is preferably configured for removable mounting on the frame member thus allowing the handicraft to be placed between the backing and display panels with its decorative front face visible through the transparent display panel.

The personalized handicraft may be in the form of a photograph representing the life-size visual representation of the user's face. Such apparatus can be especially featured to provide an unusual application so as to assist the user in selecting clothing articles which coordinate to form an attractive outfit for that user. It is known in the art to provide facilities in tourist spots to capture user's facial illustration by photographic techniques and print the facial image in reduced size on a plate, mug or T-shirt for souvenir purpose. The concept of the invention can be readily extended to provide a garment hanger equipped with a life-size facial illustration of the user in these tourist spots so as to provide a more meaningful and useful souvenir. Another application of the invention is for an apparel retail shop to instantly capture the life size facial image of preferred customer and print it on the medial portion of a garment hanger. The customer then make use of this special hanger to support and coordinate their selected apparel and have a quick appraisal of the harmony effect with his/her face on it without actually putting on the apparel.

In accordance of a third embodiment, the invented apparatus can be attached to a regular garment hanger supporting an apparel. This design enables the customer to have an instant viewing of the apparel to match his/her face without removing the garment from its hanger and put it onto the first embodiment displayed with a facial image of the user.

In accordance with the second embodiment, the frame member defines a receptacle for accommodating a three dimensional handicraft such as a floral arrangement.

It is intended that embodiments of the invention include, i.e., be packaged together with, a set of craft materials for enabling a child to produce the handicraft to be accommodated in the frame member. Such set of material may include computer software in the form of magnetic disk memory or CD ROM to facilitate the formation of the personalized handicraft desired.

The novel features of the invention are set forth with particularity in the appended claims. The invention will best be understood from the following description, when read in conjunction with the accompanying drawings.

DESCRIPTION OF THE DRAWINGS

FIG. 11 is a plan view of a second preferred embodiment of the invention depicting a handicraft display apparatus including a receptacle for accommodating a three dimensional handicraft;

FIG. 12 depicts an exemplary three dimensional handicraft comprising a floral arrangement;

FIG. 13 is an enlarged isometric view depicting the receptacle of FIG. 11 and showing the utilization of partitions therein;

FIG. 14 is a front plan view of the display apparatus of FIG. 11 containing the floral arrangement of FIG. 12;

DETAILED DESCRIPTION

Figure 1:
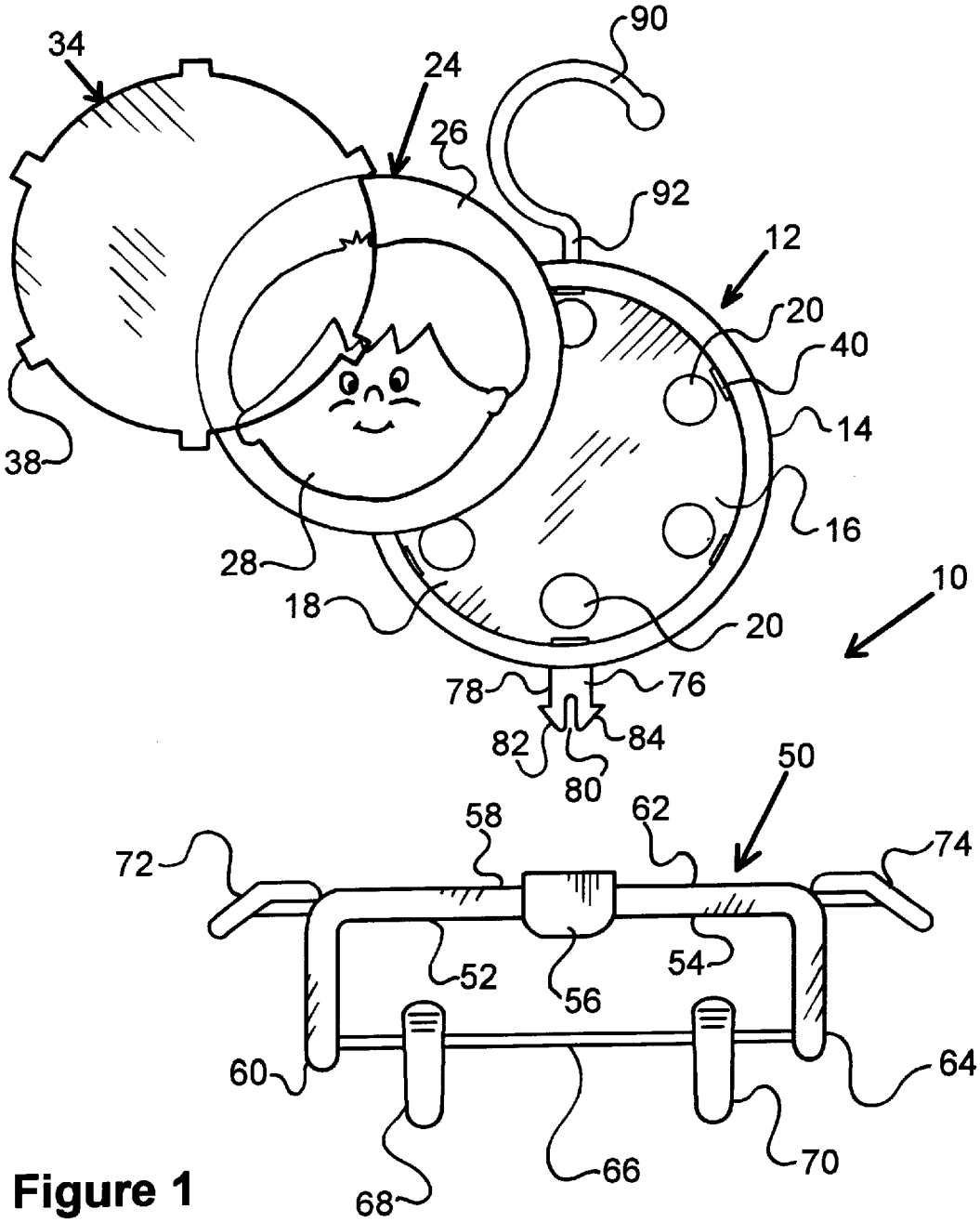
FIG. 1 is an exploded view of a first preferred embodiment of applicants handicraft display apparatus.

Attention is initially directed to FIG. 1 which depicts an exploded view of a first embodiment 10 in accordance with the invention particularly configured to encourage a child to create and display a handicraft while also encouraging that child to properly care for his/her articles of clothing. The apparatus 10 is comprised of a frame member 12. The frame member 12 is formed by a substantially rigid peripheral member 14 which frames a display area 16. The peripheral member 14 is bridged by a backing panel 18. Holes 20 are preferably formed in the backing panel 18 to facilitate the removable mounting of a handicraft 24 in the display area 16 overlaying the backing panel 18. A suspension or hook member 90 extends radially outward from the frame member 12 for vertically suspending the structural member from a horizontally oriented supporting surface (not shown) such as a wall mounted hook, a door top, or a horizontal rod.

Figure 8:
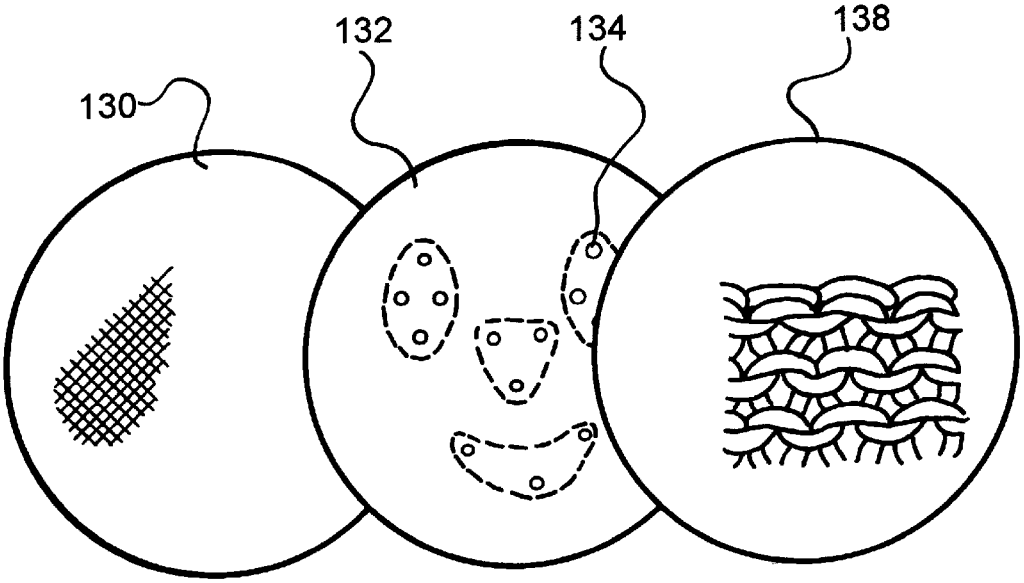
FIGS. 8, 9, and 10 depict a kit of exemplary elements which is preferably packaged together with the display apparatus for enabling a child to create a handicraft suitable for mounting in the display apparatus.
Figure 9:
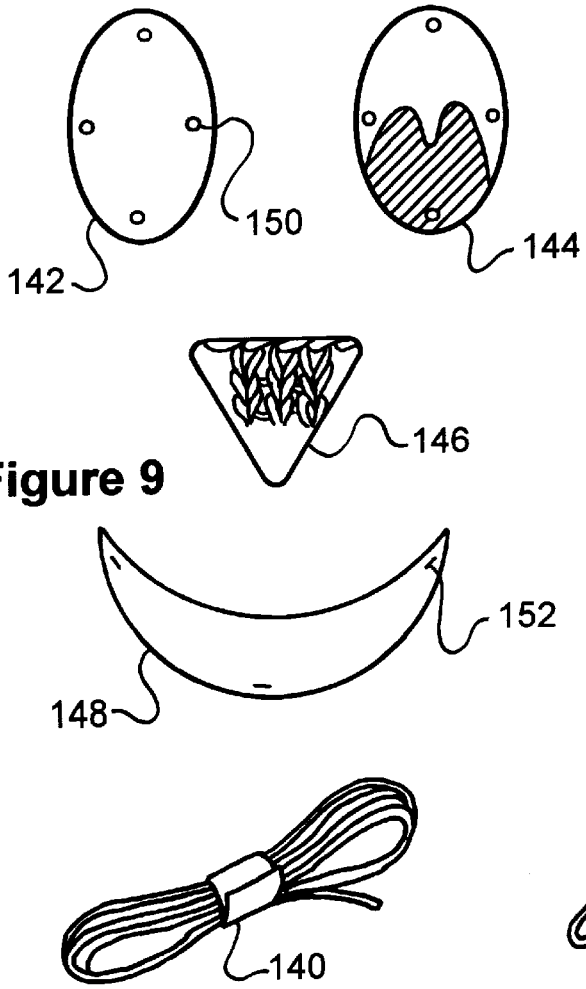
Figure 10:
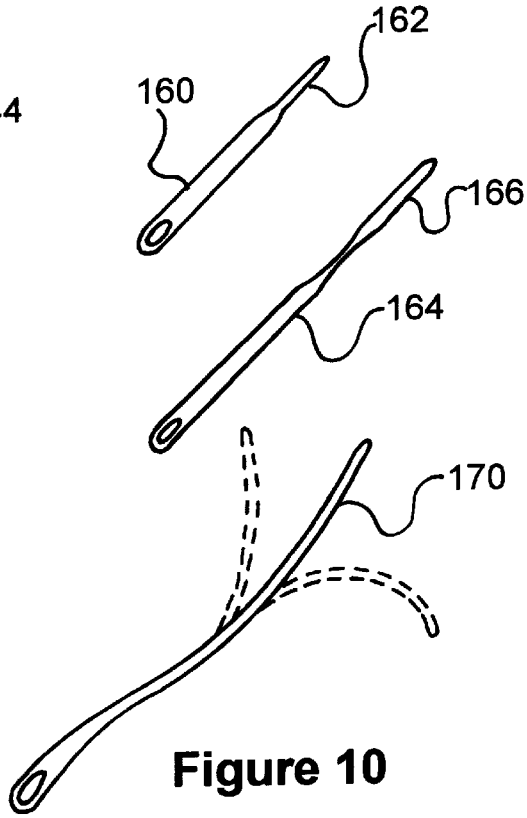

The handicraft 24 can comprise any of various planar structures having a front face 26 bearing a decorative pattern 28. The invention contemplates a great variety of decorative patterns and techniques for their formation. For example only, the handicraft 24 can comprise a picture, drawing, painting, photograph or needlework dimensioned to fit within the periphery defined by peripheral member 14. In perhaps its simplest form, the pattern 28 can be a hand drawing formed on a blank piece of paper. Alternatively, as will be discussed hereinafter, the pattern can be formed by various other art or craft techniques such as cutting out preprinted elements and adhering them to a base sheet (FIG. 4) and/or forming a handicraft using needlework techniques as are generally represented by FIGS. 8–10. It is intended that the display apparatus 10 be provided as a kit together with craft materials and/or tools for forming the handicraft.

As will be discussed hereinafter, it is intended that the handicraft 24 to be displayed be mounted against the backing panel 18 within the periphery defined by peripheral member 14. A transparent display panel 34 is provided and is intended for mounting on the frame member 12, sandwiching the handicraft 24 between the display panel 34 and backing panel 18, with the front face 26 of the handicraft 24 visible through the transparent display panel 34.

Figure 2A:
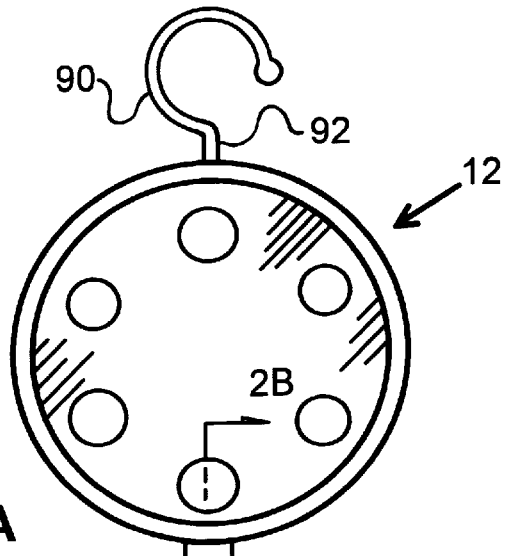
FIG. 2A is a front plan view of the frame member of FIG. 1.
Figure 2B:
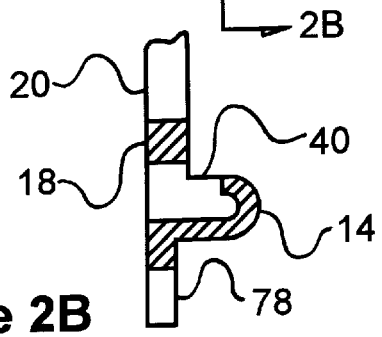
FIG. 2B is a sectional view taken substantially along the plane 2B—2B of FIG. 2A.

The display panel 34 is preferably provided with radially extending tabs 38 dimensioned and located to be removably received within mating slots 40 (FIG. 2B) defined between the backing panel 18 and the peripheral member 14. The frame member 12 is configured for attachment to a device 50 for supporting clothing articles. The device 50 essentially is comprised of first and second arms 52, 54 which extend outwardly in opposite directions from a medial member 56. More particularly, arm 52 has a first end 58 secured to medial member 56 and a second substantially free end 60. Similarly, arm 54 has a first or inner end 62 secured to medial member 56 and a second free end 64. Ends 60 and 64 are preferably bridged by a bar 66 carrying spring urged clips 68, 70 suitable for holding a lower garment such as a skirt or trousers. Extender members 72 and 74 are respectively mounted on arms 52 and 54 for extending the effective width of the device 50 to enable the device to grow with a child as the child's clothing size increases.

The frame member 12 is provided with a mounting member 76 for attaching the frame member to the device 50. More particularly, the mounting member 76 comprises a bifurcated stud 78 extending radially outward from the peripheral member 14. The stud is bifurcated by slot 80 which forms portions 82, 84 which can be resiliently urged together to enable them to pass into a slot (not shown) formed in medial member 56 for securing frame member 12 to device 50. A hook member 90 having a shaft 92 also extends radially from the peripheral member 14, substantially diametrically displaced from the mounting stud 78. When the embodiment is used to display life size human face photograph of the user to coordinate selection of apparel, the frame member (display member) 12 and the garment supporting device 50 are preferably to be separated parts to be attached together for use. This arrangement will enable a universal frame member 12 to be attached with different sizes of supporting device 50 to suit different body sizes of the users.

Figure 3:
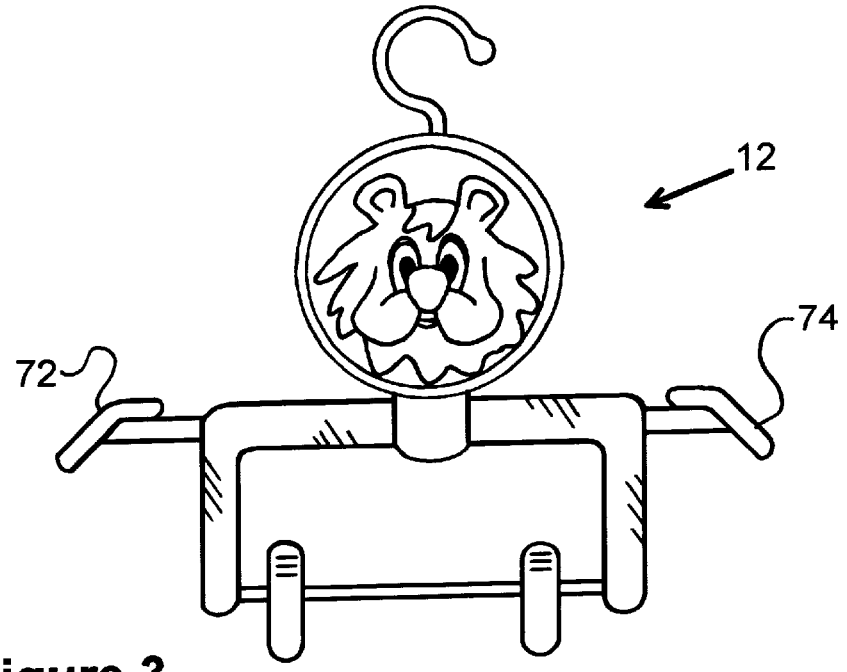
FIG. 3 is a front plan view of a fully assembled first preferred embodiment of the invention showing the extender members in their extended position.

FIG. 3 depicts the display apparatus of FIG. 1 in its fully assembled condition with its extender members 72, 74 fully extended.

Figure 4:
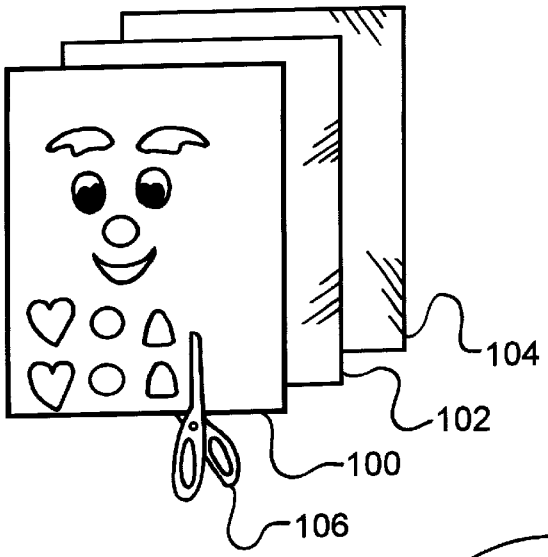
FIG. 4 schematically depicts various materials for use by a child to create a handicraft.
Figure 5:
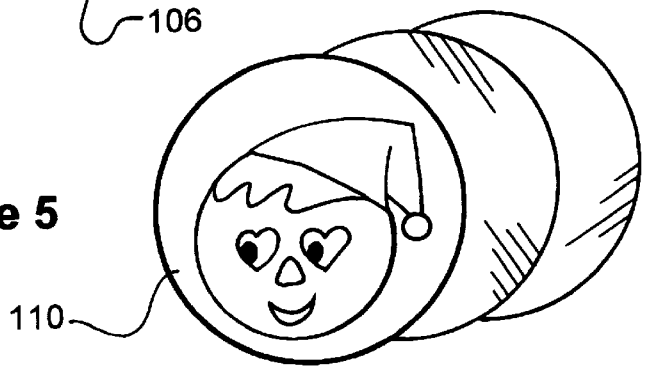
FIG. 5 depicts a child's handicraft created from the materials of FIG. 4.

FIG. 4 depicts a typical craft which can be utilized by a child to form a handicraft for display in the apparatus of FIG. 10. Note that various sheets of paper 100, 102, 104, preferably of different colors, can be provided, each bearing different elements of a picture or decorative pattern which can be utilized by a child user to form a composite design. By cutting out the selected elements utilizing scissors 106, the child is able to create the handicraft 110 depicted in FIG. 5. It should be noted that the handicraft formation tool may include computer software stored on optical storage means such as CD ROM or magnetic storage means. These computer programs may enable the children to form a facial illustration on the computer, alternating the colors, shapes, size and positioning of facial elements before the facial illustration is printed for displaying on the apparatus. Templates of facial illustrations including photographs can be provided in the computer software for younger children to easier start with a facial design. Alternatively, the user may import a facial image from a photograph through a scanner and make use of the computer to touch up and resize the facial image before printing. More advanced programming may permit the user to perform substantial modification such as changing of hair style before the image is printed through a printing equipment.

Figure 6:
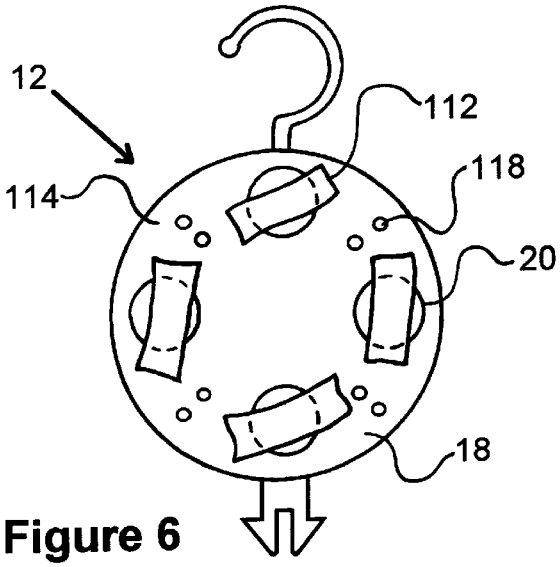
FIG. 6 depicts the rear view of the frame member showing one manner of removably mounting the handicraft in the frame member.

The handicraft 110 can be removably mounted in the frame member 12 as shown in FIG. 6. More particularly, pieces of adhesive tape 112 can be secured to the rear face 114 of the backing panel 18 across the holes 20. The adhesive face of tape 112 bears against the rear face 114 and extends through the holes 20 to engage and mount the rear face of handicraft 110.

Alternatively and additionally, pairs of small holes 118 can be provided in the backing panel 18 to permit a handicraft to be stitched to the backing panel.

Figure 7:
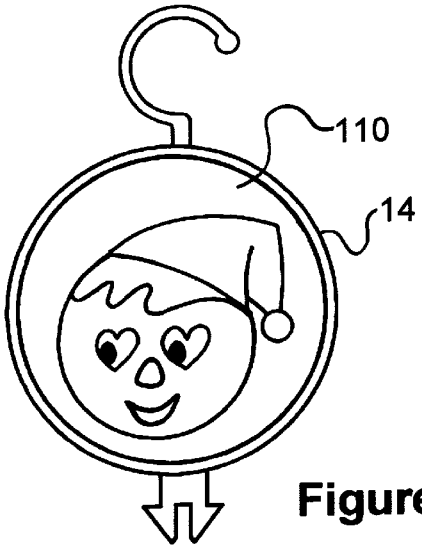
FIG. 7 is a front plan view of the frame member of FIG. 6.

FIG. 7 shows a front view of the frame member 12 displaying the handicraft 110 within the parameter of member 14. As has previously been discussed, a transparent display panel 34 is preferably used to overlay the handicraft 110.

FIGS. 8, 9 and 10 illustrate elements of a typical needlework art kit which can be provided with the apparatus 10 for encouraging a child to create an display handicrafts. FIG. 8 shows alternative base materials. For example, 130 represents a canvas or spongy backing material. 132 represents a fabric sheet preprinted with a pattern. Prepunched holes 134 are provided to facilitate the child's effort. 138 represents a knitted base material. FIG. 9 depicts yarn 140 which can be utilized by the child to apply various elements 142, 144, 146, 148 to the base materials such as 130, 132, 138. The elements depicted in FIG. 9 may be of particular shape and color and represent items such as eyes, noses, etc. These elements can also be provided with prepunched or cut apertures 150 or slots 152 to facilitate the child's work. FIG. 10 depicts typical needles for allowing the child to create the handicraft. Needle 160 is designed with a narrow elastic region 162 to minimize injury. Needle 164 is provided with a more rigid head 166 to facilitate stitching. A flexible child safe plastic needle is depicted in FIG. 10 at 170.

Attention is now directed to FIG. 11 which illustrates a second preferred embodiment of a display apparatus in accordance with the present invention. The apparatus 200 of FIG. 11 is comprised of a frame member 202 defining a pouch 204 forming an open receptacle 206. A hook 208 extends from the frame member 202 for suspending it from a horizontally oriented surface. First and second arms 210, 212 extend in opposite directions from the frame member 202 for supporting articles of clothing thereon. The arms 210, 212 respectively terminate at ends 214, 216. A rod 218 extends between ends 214 and 216 and supports spring urged clips 220, 222 for retaining skirts or trousers. Preferably, the arms 210, 212 also carry a adjustable extender members 224, 226 which enable the width of the apparatus 200 to be adjusted.

The receptacle 206 is configured to accommodate a three dimensional handicraft such as a floral arrangement 240, depicted in FIG. 12. The floral arrangement 240 is shown as being comprised of separate elements 242, 244, 246 which can all be inserted into the receptacle 206 separately, or bunched together by an appropriate tie 250. The receptacle 206 can be entirely open or can be partitioned by walls 254 as shown in FIG. 13.

FIG. 14, depicts an apparatus in accordance with the invention in its final form for displaying the floral arrangement 240 and for simultaneously supporting a clothing article 260.

Figure 17:
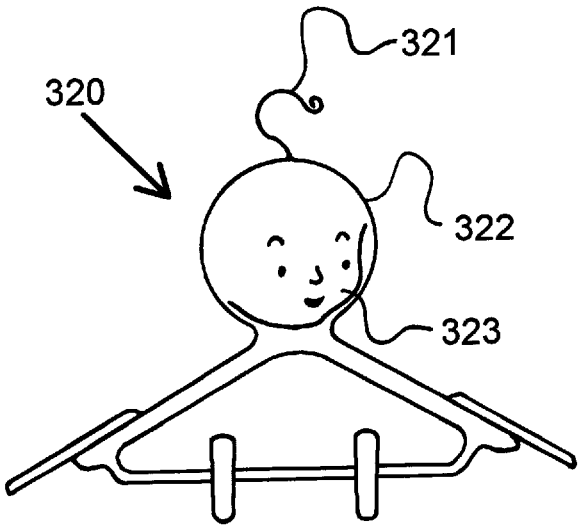
FIG. 17 depicts a life size human facial image printed onto the medial display portion of a garment hanger.

Attention is now directed to FIG. 17 which illustrates another embodiment 320 of the invention comprising an apparatus especially configured to assist a user to select clothing articles which coordinate to form an attractive outfit for that user. More particularly, the apparatus of FIG. 17 is comprised of a structural member 322, essentially in the form of a circular disk, having a display surface 323. As will be seen hereinafter, the surface 323 is used to mount a substantially life-size visual representation of a user's face. Thus, the surface 323 is dimensioned so that it is at least 150 millimeters in height and 100 millimeters in width, as viewed in FIG. 17.

Figure 15A:
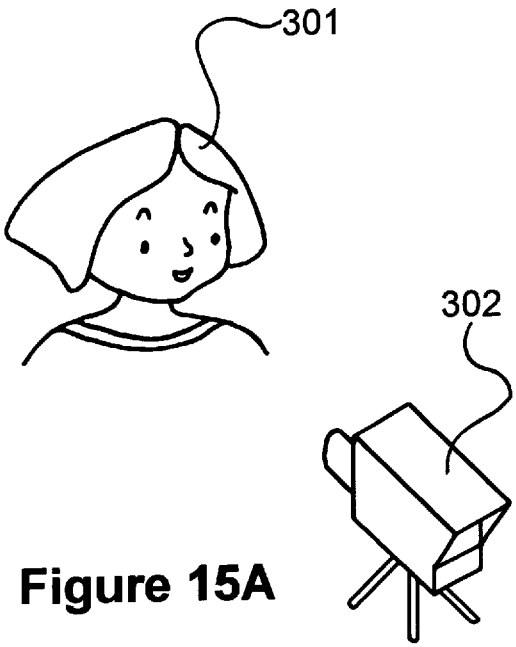
FIG. 15A illustrates a set up to capture the visual representation of a real human face.
Figure 15B:
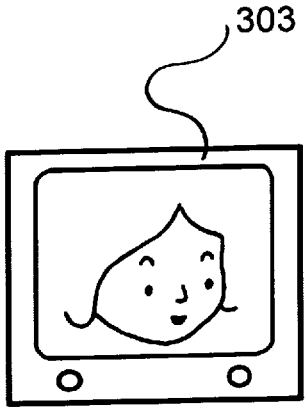
FIG. 15B illustrates the captured human face image to be displayed onto a screen for monitoring, editing or modification purpose.

In accordance with the invention, a visual representation of a human face is formed on the surface 323 of structural member 322. This visual representation can be created in various aforementioned ways of creating handicraft including conventional photography. However, it is contemplated that the preferred way would be to use a video camera 302 (FIG. 15A) to image the face of a user 301 with the output from a video camera being first presented on a display monitor 303 (FIG. 15B). The capture image of the face is then converted into digital data stored in electronic data storage means. Utilizing editing techniques, an operator can manipulate the image as desired and then print a hard copy representation of the user's face. Typical editing features may include the manipulation of colors, shapes, sizes, positions of the object (the human face) and the addition of computer generated visual effects. This hard copy is then mounted on the surface 323 of structural member 322. More particularly, note structural member 322 in FIG. 17 which bears on its surface 323 a visual representation of the edited image displayed by monitor 303. Alternatively, the captured real human face can be printed onto the surface 323 directly. Note in FIG. 18 that exemplary upper and lower garments are suspended from the invented apparatus. In order to support the lower garment such as trousers and skirts in appropriate position of the display set up, a suitable lower garment supporting means such as traditional skirt hanger is to be included into the display apparatus positioned in a suitable position beneath the upper garment supporting portion.

The apparatus having the facial image of a person is not only useful to the person himself; it can also be used by people to simulate the presence of their friends or relatives. For example, the apparatus may be used as a clothing gift selection tool by people to select appropriate for their friends or relatives without the actual presence of the person in the retail shop.

Figure 18:
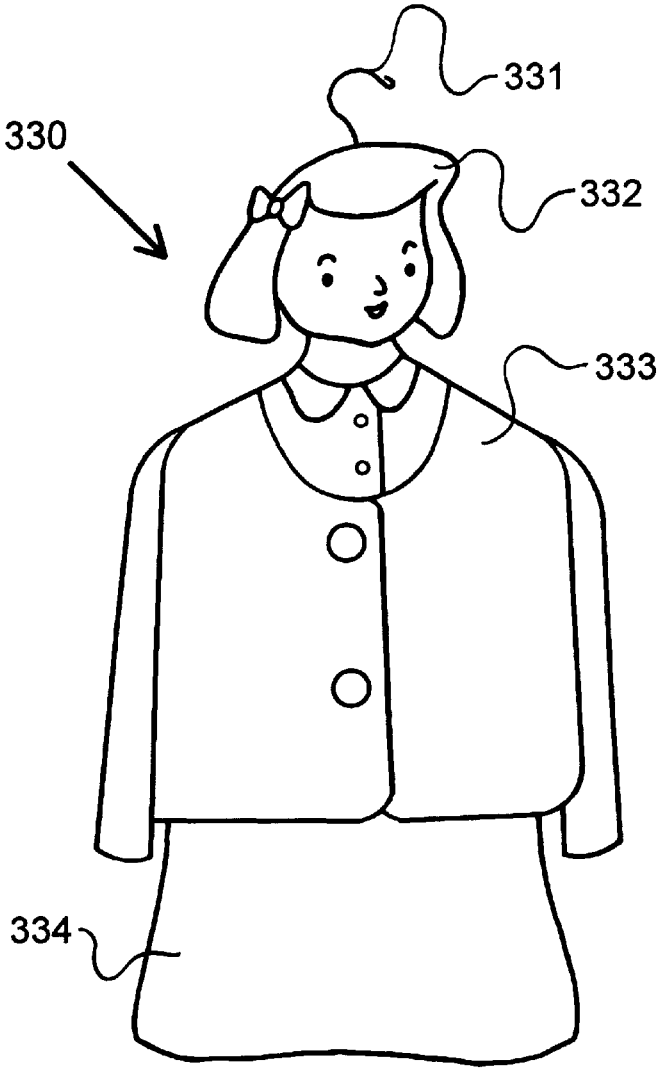
FIG. 18 is a finished view of the apparatus supporting an apparel to be viewed.
Figure 19:
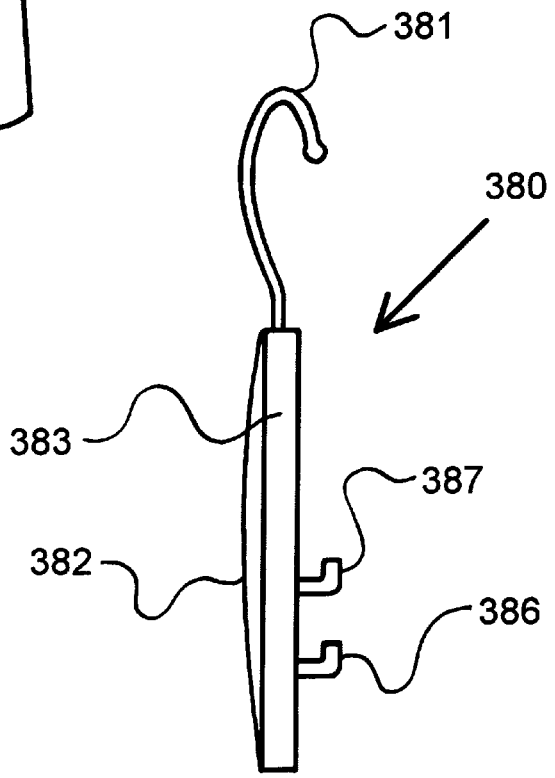
FIG. 19 is a side view of another embodiment to be attached with an apparel supported by a regular garment hanger to provide the similar desirable viewing effect.

All the above embodiments requires the apparel to be put onto the hanger frame of the display apparatus to provide the visual effect. FIG. 19 depicts an improved embodiment such that various apparels supported on different garment hangers can be readily attached with the similar facial photographic frame one by one without actually removing the apparel from the respective garment hangers and to put it onto the supporting arms of the displaying apparatus. The display member 380 comprises a first suspension member 381, a facial image printing 382, a frame member 383 and a second suspension member 386. Similar to the suspension member 321 of FIG. 18, the first suspension member 381 is used as the hook of a regular garment hanger to support the display apparatus as well as the apparel supported. The second suspension member is to receive the hook member of an external regular garment hanger such that the apparel supported by the external garment hanger can be coordinated to a position appropriately below the facial illustration 382. It is desirable that the position of the second suspension member be adjustable to adjust the relative positions of the facial image and the apparel supported. Alternatively multiple selections of the second suspension members at different positions such as 386 and 387 are provided to offer the similar adjustable feature of the aforementioned second suspension member.

Figure 16A:
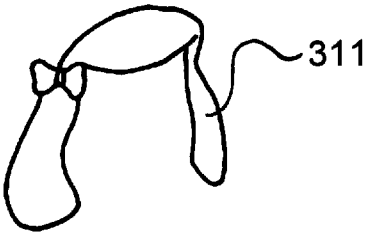
FIGS. 16A and 16B respectively depict hair simulation members to be placed in front of the facial image captured.
Figure 16B:
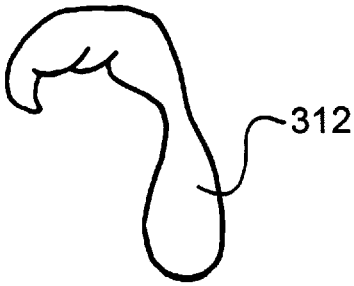

Attention is now called to FIGS. 16A and 16B which respectively show different embodiments of a hair simulation member 311, 312. The members 311, 312 are preferably configured for removable mounting on the structural member 322 as depicted in FIG. 18. Alternatively, the hair member can be generated by the computer software. A separated hair member not only provides opportunity for an user to try the looking of different hair style but also enabling a standard size facial displaying area to work with people of different hair styles. Note also in FIG. 18 that an upper garment 333 is supported and conceals the elongate arms 210, 212 thus forming an outfit with the lower garment skirt 334. For a realistic facial presentation, the facial image is preferably to be printed onto a sheet of material and the excess portion around the sides of the facial image is trimmed off before placing the facial image onto the display structural member 322.

Accordingly, by providing the apparatus depicted in FIG. 17, modified by a visual representation of a user's face applied to the structural member mounting surface 323, and optionally supplemented by a hair simulation member 311, a user is able to support articles of clothing on the apparatus 330, as depicted in FIG. 18, to enable the user to appraise the visual appearance of the outfit, i.e., collection of clothing articles and accessories.

From the foregoing, it should now be appreciated that applicant has disclosed herein embodiments of an apparatus which function to display handicrafts and which functions to support articles of clothing. It is intended that apparatus in accordance with the invention be utilized by parents to encourage children to create and display handicrafts while also encouraging them to properly care for their articles of clothing. The application of the invention is also intended for a user to easily coordinate or harmonize apparel before putting the clothing on. It is contemplated that an apparatus in accordance with the invention be supported on a horizontal surface of a wall mounted hook member or a door top, preferably out of the closet. Although detailed embodiments of the invention have been disclosed, it is recognized that variations and modifications, all within the spirit of the invention, will occur to those skilled in the art. It is accordingly intended that all such variations and modifications be encompassed by the appended claims.

I claim:

1. A setup for creating and displaying a handicraft comprising:

a frame member defining a display region;

suspension means extending from said frame member for vertically suspending said frame member first and second elongated arms connected to said frame member and respectively extending in different direction from each other for supporting an article of clothing and a software package to work with a computing device enabling the formation of a handicraft to be displayed on said display region.

2. The setup of claim 1 wherein said software package is configured to enable the formation of a facial illustration to be displayed on said display region.

3. The setup of claim 1 wherein said software package is further configured to enable the printing of said handicraft from a printer.

* * * * *